United States Patent [19]

Byrd, Jr.

[11] 4,055,926

[45] Nov. 1, 1977

[54] REFRACTORY FIBER BLANKET MODULE

[75] Inventor: Carlisle O. Byrd, Jr., Houston, Tex.

[73] Assignee: Johns-Manville Corporation, Denver, Colo.

[21] Appl. No.: 757,748

[22] Filed: Jan. 7, 1977

Related U.S. Application Data

[63] Continuation-in-part of Ser. No. 603,391, Aug. 11, 1975, Pat. No. 4,002,996, which is a continuation-in-part of Ser. No. 475,439, June 3, 1974, Pat. No. 3,952,470.

[51] Int. Cl.[2] ..... E04B 1/80

[52] U.S. Cl. ..... 52/475; 52/509

[58] Field of Search ..... 110/1 A, 99 R; 52/404, 52/406, 508, 509, 145; 181/33 G, 33 GA, 33 AB; 432/247-252; 428/99, 121, 126

[56] References Cited

U.S. PATENT DOCUMENTS

| | | | |
|---|---|---|---|
| 2,355,608 | 8/1944 | Stieger | 52/145 |
| 2,897,908 | 8/1959 | Barshefsky | 52/145 |
| 3,282,578 | 11/1966 | Ulbrich | 432/247 |

*Primary Examiner*—John E. Murtagh

*Attorney, Agent, or Firm*—Robert M. Krone; Joseph J. Kelly; James W. McClain

[57] ABSTRACT

A fiber blanket module having a rectangular or box-shaped frame attached by suitable attachment structure to a wall of a furnace or other high temperature equipment to insulate such equipment. Each of two strips of woven metal oxide fiber cloth is suspended between one set of opposite sides of the frame, forming a pocket. The pocket is filled with suitable insulating material, which includes bulk, unconsolidated ceramic fiber, refractory fiber blankets, and the like.

9 Claims, 1 Drawing Figure

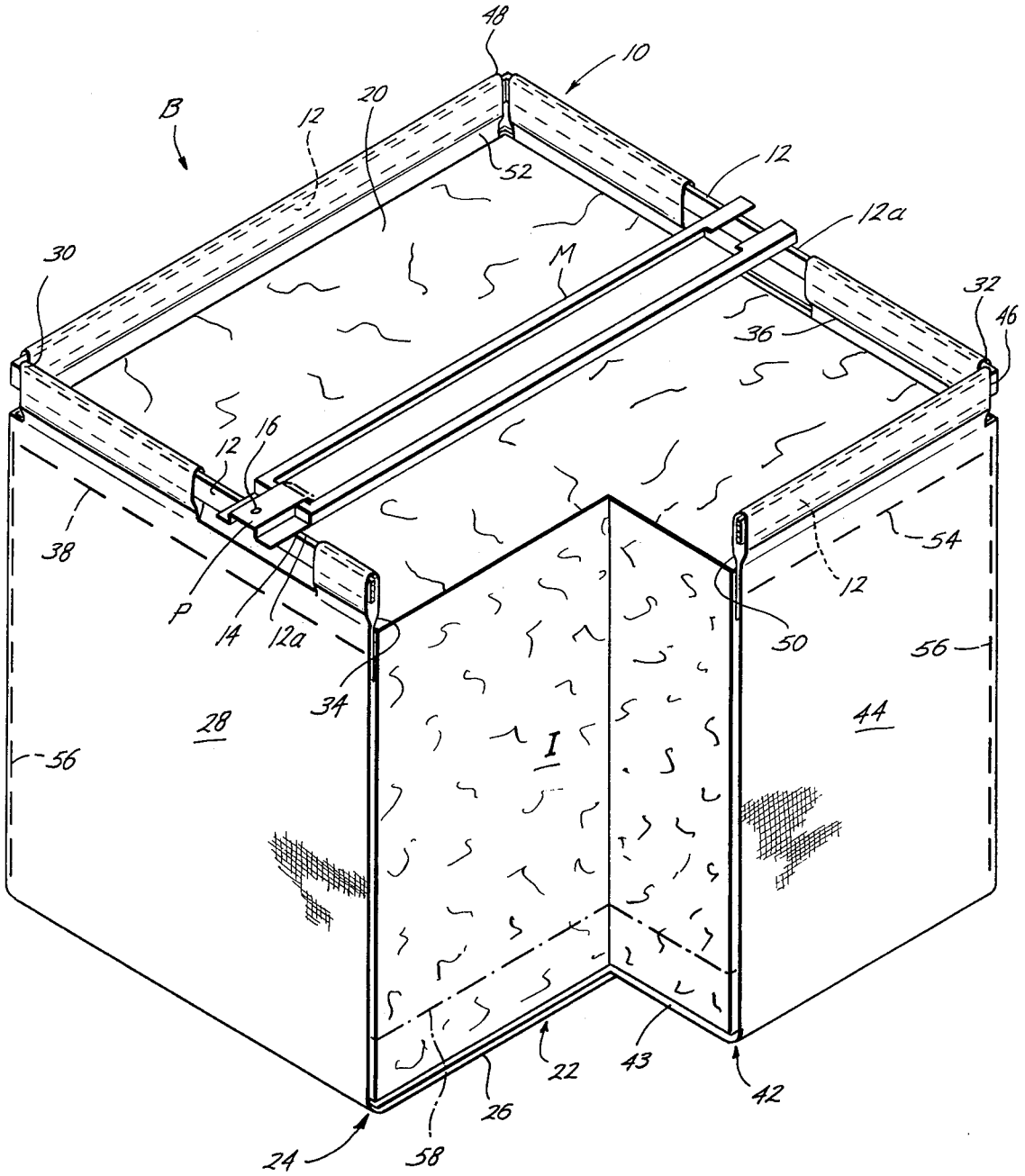
48
10
B
12
20
52
12
12a
30
M
32
46
36
16
12
38
54
12
P
14
12a
50
56
34
28
44
I
56
22
43
42
26
24
58

REFRACTORY FIBER BLANKET MODULE

CROSS-REFERENCE TO RELATED APPLICATIONS

This application is a continuation-in-part of copending U.S. Pat. application Ser. No. 603,391, filed Aug. 11, 1975, now U.S. Pat. No. 4,002,996 which in turn is a continuation-in-part of U.S. Pat. application Ser. No. 475,439, filed June 3, 1974, now U.S. Pat. No. 3,952,470. Other pending continuations-in-part of these parent applications are U.S. Pat. applications Ser. Nos. 757,749 and 757,750 filed of even date herewith. Another related pending application is U.S. Pat. application Ser. No. 757,772, filed of even date herewith.

BACKGROUND OF THE INVENTION

1. Field of Invention

The present invention relates to modular refractory fiber blanket furnace lining systems.

2. Description of Prior Art

Refractory fiber blankets made from refractory materials such as chromia-alumina-silica, alumina-silica compositions and zirconia compositions have become desirable as furnace insulation because of their ability to withstand high temperatures. The fiber blanket material has been attached in a layered construction arrangement to the furnace wall using attachment structure, as exemplified in U.S. Pat. Nos. 3,523,395 and 3,605,370.

Another approach has been to form modules or blocks of refractory fiber blanket material, as exemplified by U.S. Pat. Nos. 3,832,815 and 3,819,468.

However, the layered construction was rather difficult to install and to repair. Further, the prior art modules which speared or impaled the relatively high cost, fragile blanket material were susceptible of blanket tearing, falling out or otherwise becoming damaged. Additionally, in certain situations, temperature rating, cost of materials or other factors often made it unduly expensive to buy and install these types of modules.

SUMMARY OF INVENTION

Briefly, the present invention provides a new and improved module for refractory fiber insulation of a wall of a furnace or like equipment. A support frame mounted with an attaching support has a pocket formed therebeneath by at least one band of metal oxide cloth. The pocket is then filled with suitable insulation material, such as bulk, unconsolidated fibers, refractory fiber blanket layers or other suitable insulating mats or panels. The pocket is preferably formed from two intersecting, U-shaped bands of metal oxide cloth forming a four-sided pouch beneath the frame for retaining the insulating material therein. The bands are preferably woven from continuous filament metal oxide fibers of alumina-boria-silica composition for high temperature insulation purposes.

BRIEF DESCRIPTION OF THE DRAWINGS

The sole FIGURE in the drawings is an isometric view, taken partly in cross-section, of an insulation module according to the present invention.

DESCRIPTION OF THE PREFERRED EMBODIMENT

Considering now a block or module B according to the present invention, an attaching frame 10 is formed from four bars or rods 12 of high temperature resistant metal or alloy or of suitable ceramic materials, such as of the type set forth in the above-referenced U.S. Pat. application Ser. No. 475,439, now U.S. Pat. No. 3,952,470. The rods 12 are connected together at each end thereof to other rods to form a square or rectangular shaped box or frame as the attaching frame member 10.

An attachment mounting member M is attached along lower end portions 14 thereof to upper center portions 12*a* of two opposite bars 12 of the frame 10. The attachment mounting member M is of the type set forth in the parent application referenced above, now U.S. Pat. No. 3,952,470. The attachment mounting M thus has an attachment pin P with an opening 16 therein for receiving a stud welding pin or suitable attaching means, and an attachment receptacle R to attach a plurality of the blocks B to the wall of the equipment being insulated in the manner set forth in the parent application, now U.S. Pat. No. 3,952,470, referred to above. It is additionally to be understood that the slide attachment mounting technique set forth in allowed co-pending U.S. Pat. application Ser. No. 603,391, set forth above, may be used to attach the block B to the wall of the equipment, where desired. The surface of the block B along which mounting with the furnace wall occurs is designated generally 20 and is termed the "cold face" in the art. The block B extends inwardly, once installed, from the cold face 20 to an inner insulation surface designated 22 known as the "hot face" in the art.

The block B includes a first band of metal oxide cloth 24. The cloth 24 is preferably formed from fibers of metal oxide which are woven as continuous fibers into a ceramic cloth of alumina-boria-silica composition. A suitable cloth, for example, is that woven from the ceramic fibers designated AB-312 of the 3M Company of St. Paul, Minn. These fibers are commercially available from the 3M Company. Further details of the fibers in their composition and characteristics are set forth in *Design News* magazine in the May 10, 1976 issue. These fibers are there stated to withstand continuous usage temperatures of 2600° F.

The cloth 24 extends from an inner surface portion 26 adjacent the hot face 22 along a first wall portion 28 and a second side wall portion on the opposite side of the block B to folds 30 and 32, respectively. Inner wall portions 34 and 36 extend inwardly from the folds 30 and 32 to enclose the rods or bars 12 therein and attach the cloth 24 to the frame 10. The inner wall portions 34 and 36 are attached to their respective side wall portions, preferably by sewing such wall portions together with metal oxide thread from which the cloth 24 is formed using a sufficient number of threads designated generally as 38. Thus, the band of cloth 24 forms a pocket 40 for receiving insulating material therein.

A second band of metallic oxide cloth 42, of the type materials used in the cloth 24, is mounted along an inner surface portion 43 within the pocket 40 inside the inner surface portion 26 of the cloth 24 and extends upwardly therefrom along a first side wall portion 44 and a second side wall portion on the opposite side of the block B to form folds 46 and 48, respectively. Inner wall portions 50 and 52 extend inwardly over the bars 12 from the folds 46 and 48 to enclose the bars 12 and mount the cloth 42 with the frame 10. The inner wall portions 50 and 52 are attached to their respective side wall portions by sewing, as indicated by threads 54 using fibers of the type set forth above. The first cloth 24 and the second cloth 42 are preferably joined together along adjacent side wall portions thereof, such as by sewing with metal oxide fiber thread of the type set forth above, as indicated generally at 56. In this manner, the pocket 40 of the block B is sealed along the sides thereof. However, a portion of the cloth bands 24 and 42 has been removed in the drawing to more clearly shown the pocket 40 formed in the interior thereof.

Once the pocket 40 is formed it is then filled with insulation material I to meet expected or specified temperature ranges for the equipment in which the block B is to be installed. For example, for lower temperature requirements, bulk, unconsolidated insulating fiber may be used to fill the pocket 40. For higher temperature requirements, layers of refractory fiber blanket or panels or boards of insulating material, as designated generally in phantom as 58, may be included if desired. Further, various types of insulating blanket or insulating panels or boards may be used depending upon expected or specified furnace temperatures. Also, several layers of blanket, board and bulk fiber may be used, if desired. The block B, once formed in the manner set forth above, can be rapidly installed in the manner set forth in the previously referenced parent application, now U.S. Pat. No. 3,952,470. Such installation can be performed by relatively unskilled crews. Further, with the bands 24 and 42 being formed from metal oxide fiber cloth from continuous filament metal oxide fibers, the structure of the block B forming the pocket 40 is capable of meeting very high temperature insulation requirements. However, the contents of the pocket 40 need only be of materials of temperature rating and thickness necessary to meet specified insulation requirements. Additionally, the cloth layers 24 and 42 protect the underlying fibers from erosion by furnace gases and from devitrification and erosion by high temperatures in the furnace. Further, the user of the block B according to the present invention is not required to utilize higher temperature material than that necessary to meet the anticipated job requirements. In this way, a user is more able to specify the requisite material to be used to fill the pocket 40 to meet specified insulation requirements. The user is thus able to maintain costs of materials within acceptable ranges and yet provide adequate material to achieve the specified insulation levels in insulating high temperature equipment according to the present invention.

The foregoing disclosure and description of the invention are illustrative and explanatory thereof and various changes in the size, shape and materials as well as in the description of the preferred embodiment may be made without departing from the spirit of the invention.

I claim:

1. A module for refractory fiber insulation of a wall of a furnace or like equipment, comprising:

a. a supporting frame member having at least two opposite sides;

b. a band of metal oxide cloth suspended between said opposite sides of said frame member to form a pocket;

c. insulating means mounted in said pocket to insulate the wall of the furnace; and d. means for attaching said supporting frame member to the wall of the furnace.

2. The structure of claim 1, wherein said supporting frame member has at least two sets of opposite sides, and said band of metal oxide cloth is suspended between one of said sets of opposite sides and further including;

a second band of metal oxide cloth suspended between another of said sets of opposite sides transversely to said band of metal oxide cloth to form said pocket.

3. The structure of claim 2, wherein said supporting frame member comprises four support bars in the form of a box-shaped support frame.

4. The structure of claim 3, wherein each of said bands of metal oxide cloth includes:

a. an inner surface portion exposed along an insulation surface to the interior of the furnace;

b. first and second side surface portions extending outwardly from said inner surface portion at first and second ends thereof, respectively, to folds formed therein for enclosing said supporting frame member; and c. first and second inner wall member portions extending inwardly from said folds; and d. means for attaching said first and second inner wall member portions to said first and second side surface portions, respectively.

5. The structure of claim 1, wherein said band of metal cloth oxide comprises:

a. an inner surface portion exposed along an insulation surface to the interior of the furnace;

b. first and second side surface portions extending outwardly from said inner surface portion at first and second ends thereof, respectively, to folds formed therein for enclosing said supporting frame member;

c. first and second inner wall member portions extending inwardly from said folds; and d. means for attaching said first and second inner wall member portions to said first and second side surface portions, respectively.

6. The structure of claim 1, wherein said insulating means comprises:

a bundle of bulk, unconsolidated ceramic fibers.

7. The structure of claim 1, wherein said insulating means comprises:

at least one layer of refractory fiber blanket.

8. The structure of claim 1, wherein said insulating means comprises:

at least one insulating mat or board.

9. The structure of claim 1, wherein said band of metal oxide cloth is woven from continuous filament metal oxide fibers.

* * * * *